US007448508B2

(12) United States Patent
Babucke et al.

(10) Patent No.: US 7,448,508 B2
(45) Date of Patent: Nov. 11, 2008

(54) BEARING TRAY OF A KITCHEN APPLIANCE

(75) Inventors: Guido Babucke, Schloβ Holte-Stukenbrock (DE); Peter Jährling, Bünde (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 502 days.

(21) Appl. No.: 11/095,499

(22) Filed: Apr. 1, 2005

(65) Prior Publication Data

US 2005/0217501 A1 Oct. 6, 2005

(30) Foreign Application Priority Data

Apr. 2, 2004 (DE) ..... 20 2004 005 475 U

(51) Int. Cl.
*A47J 47/00* (2006.01)

(52) U.S. Cl. ..... 211/126.9

(58) Field of Classification Search ..... 211/194, 211/126.9, 162, 90.02, 90.03, 106, 106.01; 16/90; 312/408, 410, 351; 108/102, 193, 108/143; 248/250, 249

See application file for complete search history.

(56) References Cited

U.S. PATENT DOCUMENTS

| | | | | |
|---|---|---|---|---|
| 3,125,225 | A * | 3/1964 | Brengman et al. | 211/126.9 |
| 5,086,936 | A * | 2/1992 | Remmers | 211/126.15 |
| 5,303,997 | A * | 4/1994 | Kropf | 312/334.4 |
| 6,112,916 | A * | 9/2000 | Barnes et al. | 211/153 |
| 6,349,717 | B1 * | 2/2002 | Thompson et al. | 126/337 R |
| 6,491,173 | B1 * | 12/2002 | Costa | 211/126.15 |

* cited by examiner

*Primary Examiner*—Sarah Purol
(74) *Attorney, Agent, or Firm*—Barnes & Thornburg LLP

(57) ABSTRACT

A support tray for a kitchen appliance having a rectangular tray and guiding devices at each mutually opposite lateral edges of the tray, the sliding devices include having a running rail connected to the tray and a guiding rail for mounting the support tray to support rods of a supporting grids in the side wall areas of the kitchen appliance. The guide rail are configured to be coupled and secured, in a rearward end area, against a lifting-off from the supporting rods when coupled thereto and to be form-lockingly secured, in a forward end area, against a displacement in the longitudinal direction of the supporting rods.

14 Claims, 13 Drawing Sheets

BEARING TRAY OF A KITCHEN APPLIANCE

CROSS REFERENCE

This non-provisional application claims benefit of German Application Number 20 2004 005 475.2 filed on Apr. 2, 2004, which disclosure is hereby incorporated by reference herein.

BACKGROUND AND SUMMARY OF INVENTION

The present invention relates to a support tray of a kitchen appliance, such as a baking oven, a refrigerator, a microwave oven or the like, the support tray having a rectangular base area.

Support trays of the above-mentioned type are known in many different constructions.

Support trays of the type involved here are used, for example, in baking ovens or microwave ovens, for receiving goods to be cooked or baked in corresponding molds or foils, In the case of refrigerators, products to be cooled or frozen are deposited on corresponding support trays.

In principle, it should be possible to place support trays at different levels in a baking oven, a refrigerator, a microwave oven or the like. Furthermore, it is desirable to be able to pull such support trays at least partially out of the above-mentioned appliances in order to be able to, for example, treat goods to be cooked or baked or to test the cooking condition. In the case of refrigerators, a support tray, which can be at least partially pulled out of the refrigerator facilitates the removal of products which are situated in the rear of the tray in the pushed-in condition.

For cleaning purposes of the support tray itself as well as for facilitating the cleaning of an interior of a baking oven, a microwave oven or a refrigerator, it is also advantageous for support trays to be completely removable from the corresponding appliances. When needed again, it should then also be possible to push the support tray, without any problem, back into its effective position in a corresponding appliance.

It is an object of the present invention to create a support tray of the above-mentioned type which can easily and without any problem be placed in a kitchen appliance and be removed therefrom and which, without the risk of a tipping, can be pulled relatively far out of a kitchen appliance.

This and other objects are achieved in that, at its mutually opposite lateral edges, the support tray is connected with running rails of guiding devices which further includes guiding rails which can be pushed onto supporting rods of supporting grids in the side wall areas of the kitchen appliance the guiding rails. In their rearward end area, the support trays is secured against a lifting-off from the supporting rods and, in the forward end area, are form-lockingly secured against a displacement in the longitudinal direction of the supporting rods.

Thus, by means of its lateral guiding devices, a support tray can be form-lockingly fixed to the supporting rods of supporting grids of a kitchen appliance such that a complete pulling-out of the support tray in the longitudinal direction of the guiding devices is not possible and a tipping of the rearward end area is prevented just as securely. This means that the support tray is pulled out corresponding to the maximal pull-out length of the guiding devices and is also secured in the loaded condition. This considerably facilitates the use of the support tray.

The guiding rails of the guiding devices are fixed on the appliance side and a pulling-out of the support tray can take place only corresponding to the maximal pull-out length of the guiding devices. The support tray remains connected with the guiding device as a whole also in the maximally pulled-out condition. A separating of the support tray from the kitchen appliance is therefore not possible by the pulling-out along the guiding devices.

If, in contrast, the support tray is to be removed from a kitchen appliance, it is first necessary to disconnect the guiding devices from the supporting grids. This can take place only by an intentional manipulation.

To this extent, the present system facilitates the handling of the support tray while the protection against possible faulty operations is considerably increased.

These and other aspects of the present disclosure will become apparent from the following detailed description of the disclosure, when considered in conjunction with accompanying drawings.

BRIEF DESCRIPTION FO THE DRAWINGS

Figure 1:
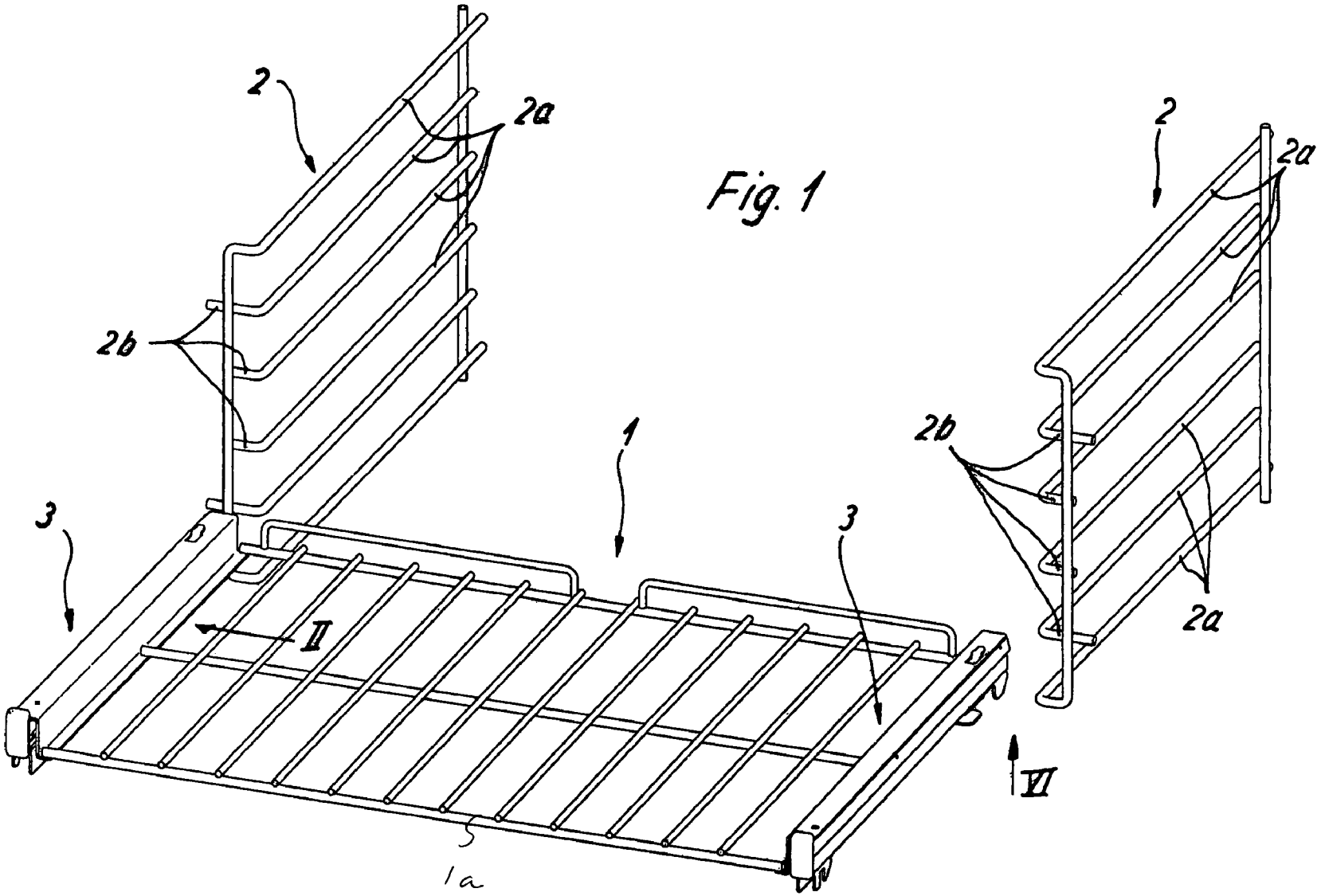
FIG. 1 is a perspective representation of a support tray according to the present disclosure and two supporting grids for receiving the support tray.
Figure 2:
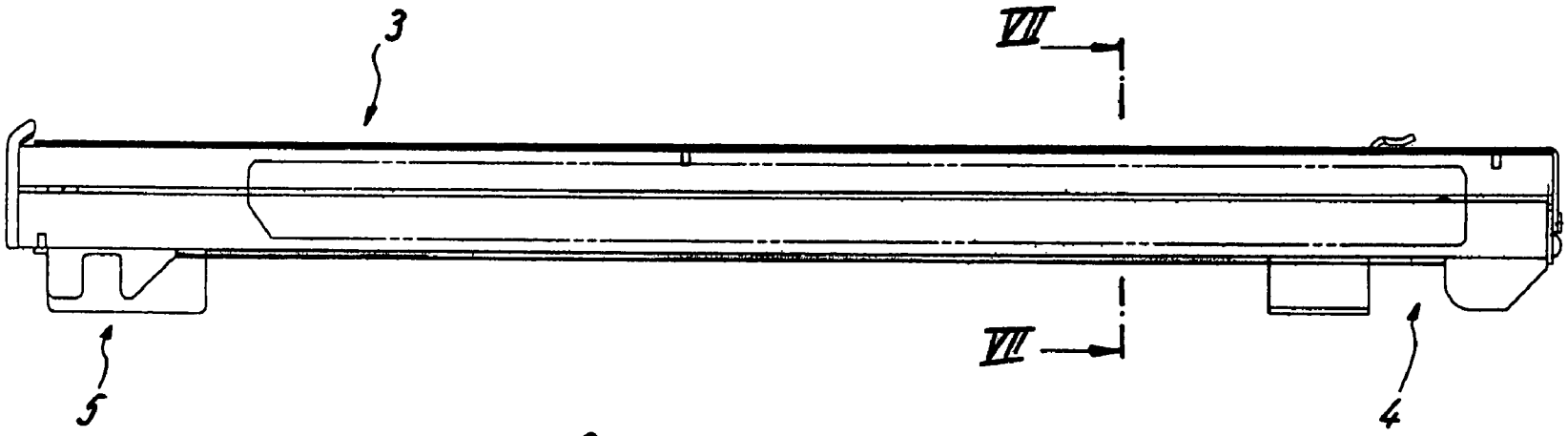
FIG. 2 is a side view of a guiding device in a retracted condition in the direction of the arrow II in FIG. 1.
Figure 6:
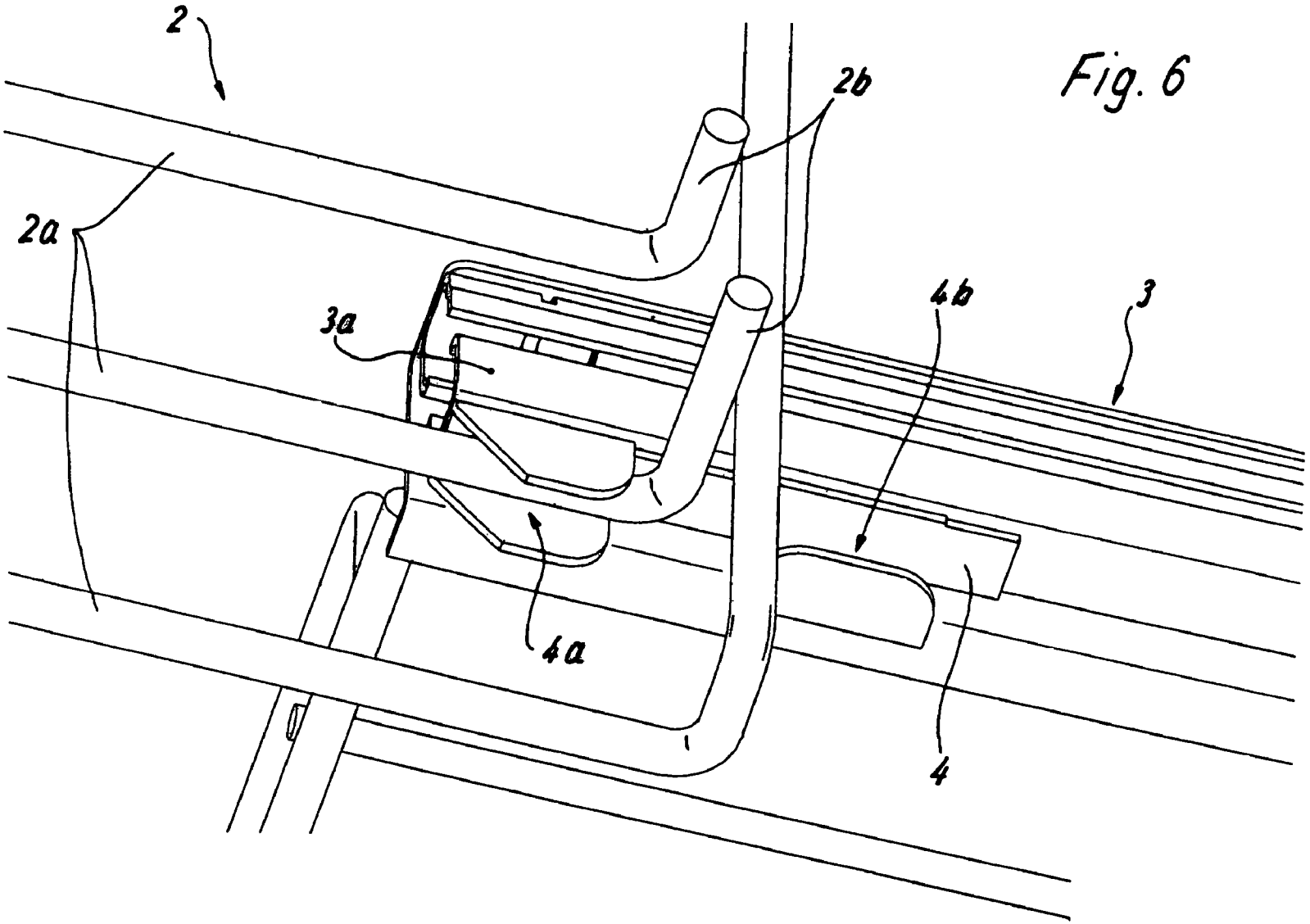
Figure 7:
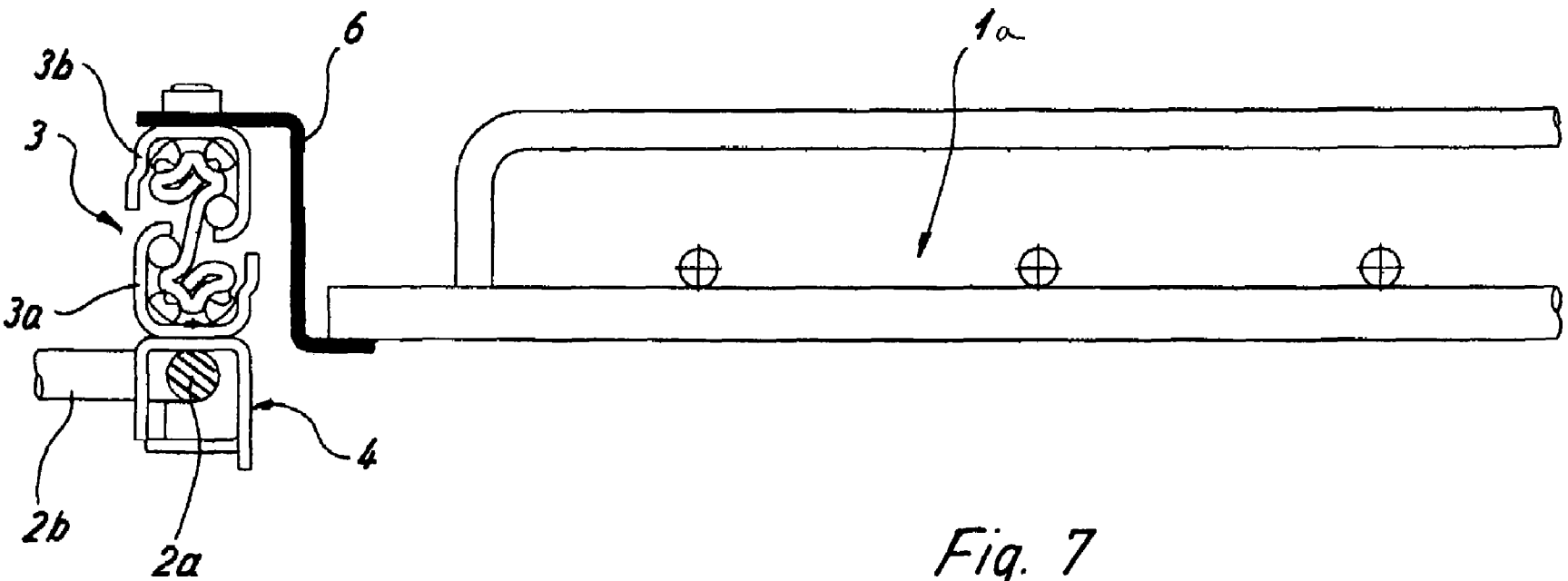
Figure 9:
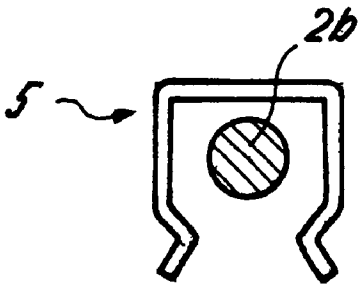
Figure 10:
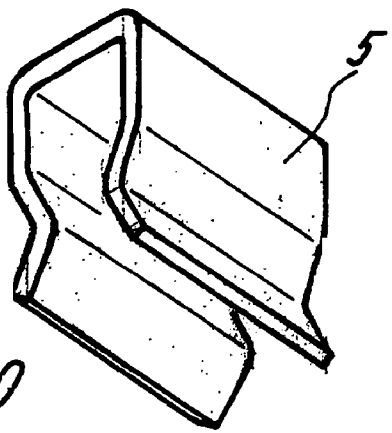
Figure 8:
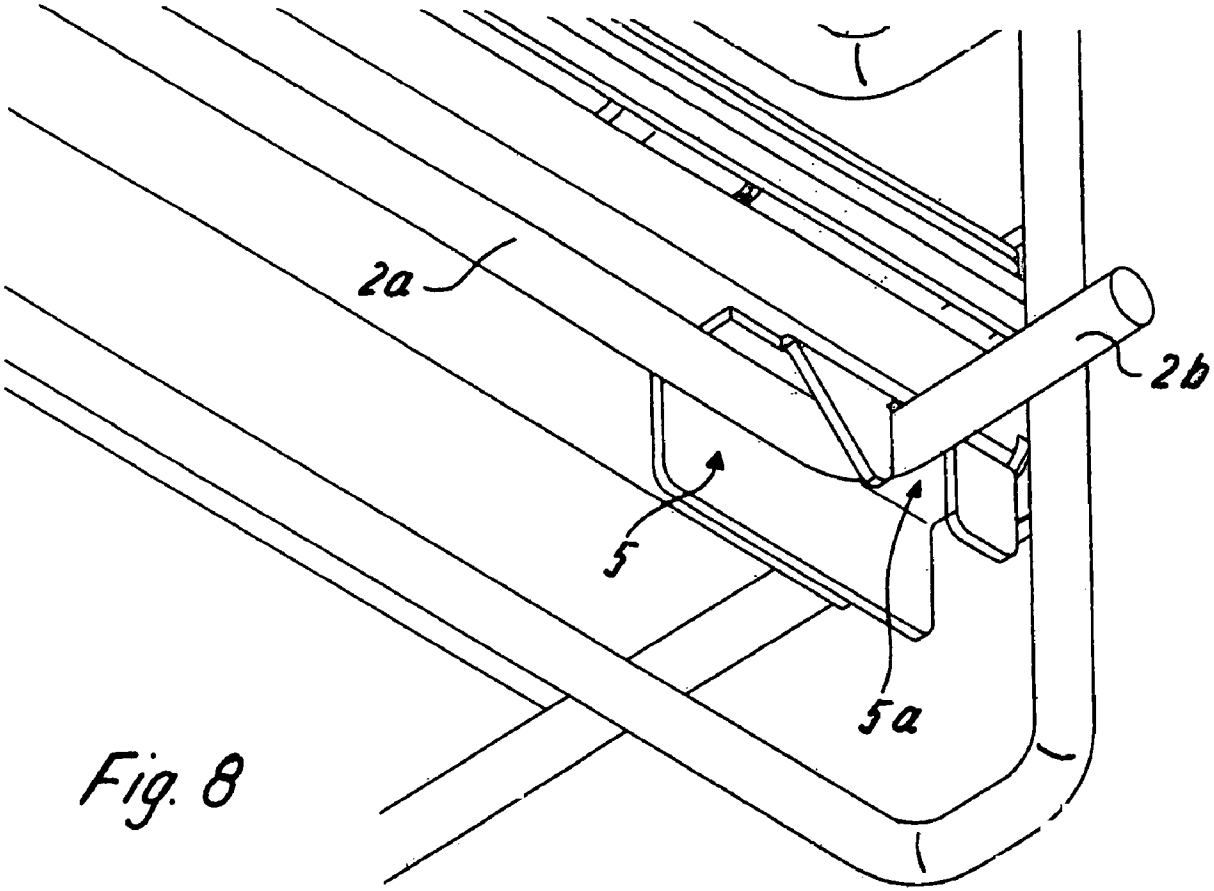
Figure 11:
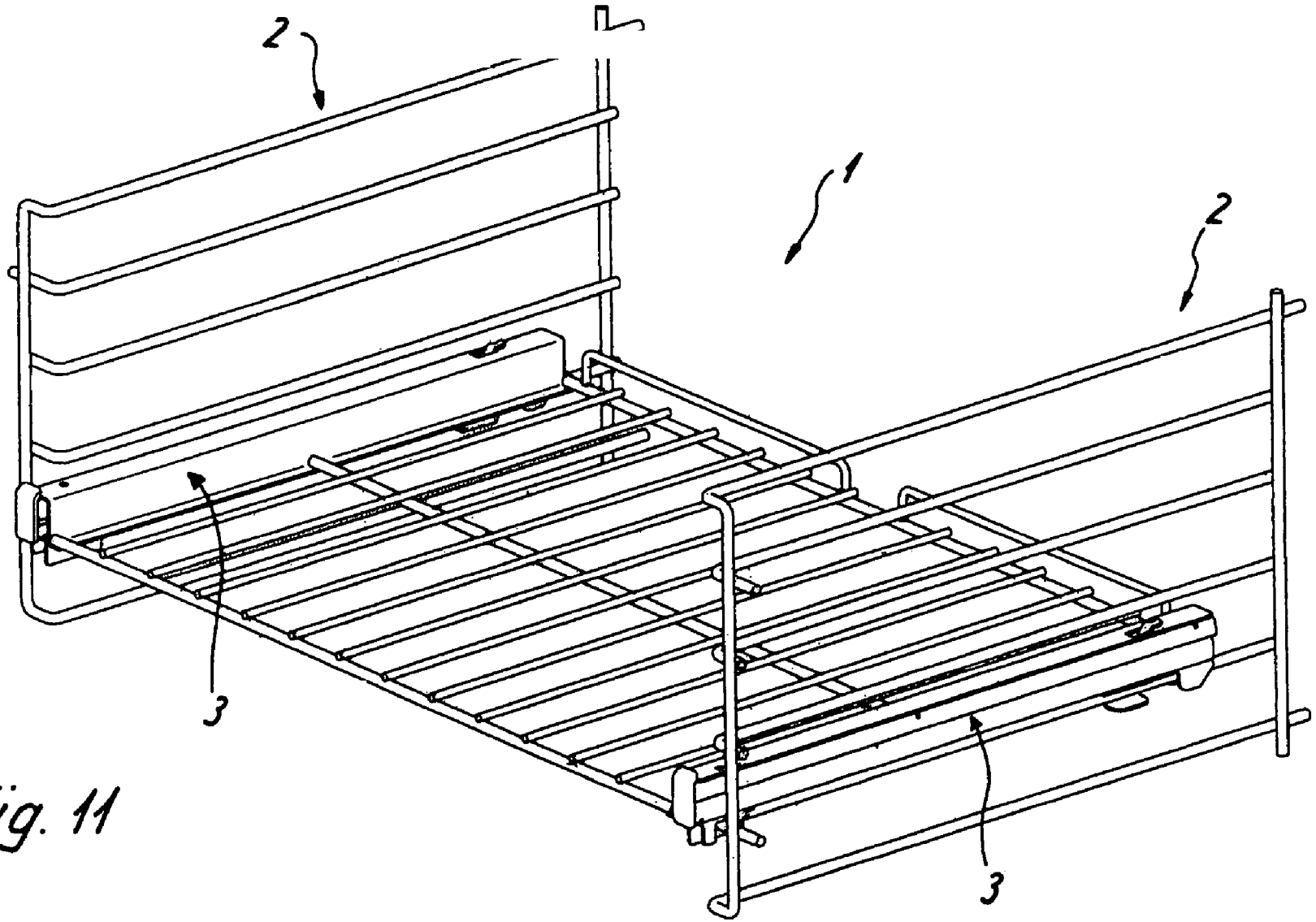
Figure 12:
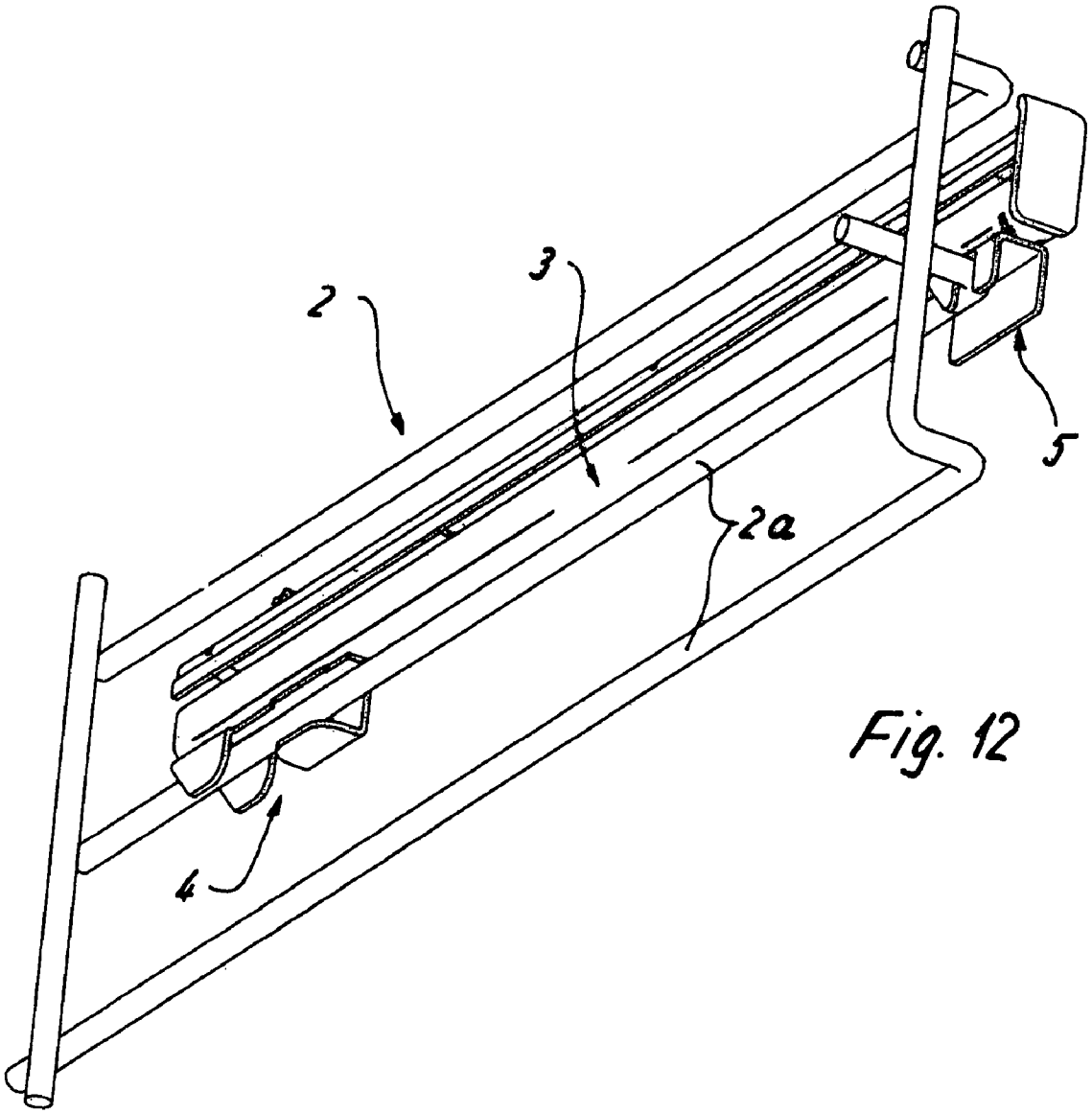
Figure 15:
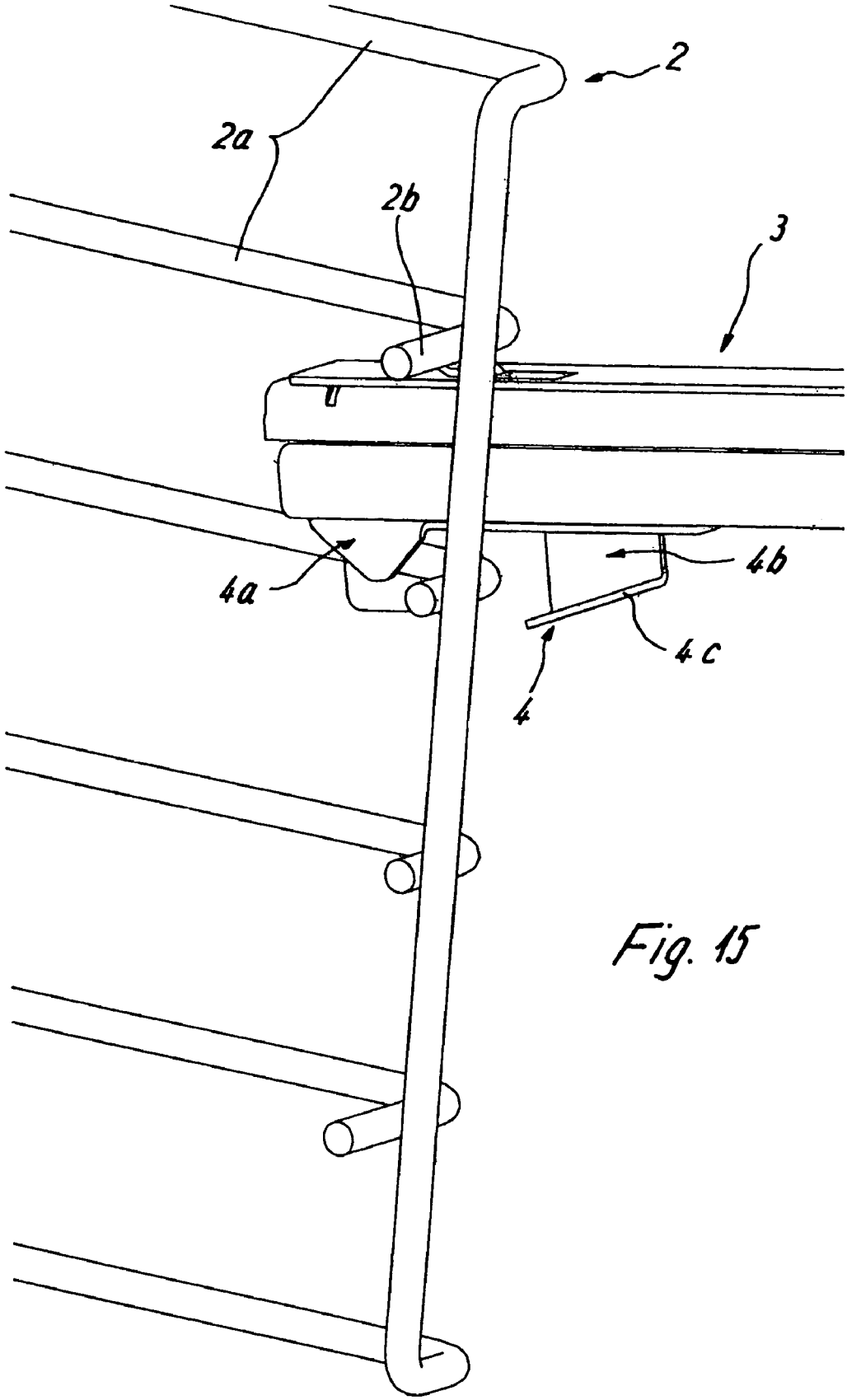

FIGS. 4*a* to 4*d* are various views of a holder for coupling a support tray with the supporting grids in the forward area;

FIGS. 5*a* to 5*d* are various views of a rearward holding device for coupling the support tray with the supporting grids in the rearward area;

FIG. 6 is a perspective partial bottom view in the direction of the arrow VI in FIG. 1 wherein a support tray is attached to a supporting grid but not yet finally mounted;

FIG. 7 is a sectional view according to Line VII-VII in FIG. 2;

FIG. 8 is a perspective partial bottom view corresponding to FIG. 6 when the support tray is completely inserted;

FIGS. 9 and 10 are different views of a forward holder according to another embodiment;

FIG. 11 is a perspective view corresponding to FIG. 1 of the support tray attached to the supporting grids;

FIG. 12 is a perspective partial view of a supporting grid with a guiding device of a support tray not illustrated in detail, which guiding device is coupled to the supporting grid;

FIGS. 13*a* to 13*d* are different views of a forward holder according to another embodiment;

FIGS. 14*a* to 14*d* are different views of a rearward holding device according to another embodiment;

FIG. 15 is a perspective partial bottom view essentially corresponding to FIG. 6 when attaching a support tray with a rearward holding device according to FIGS. 14*a* to 14*d;*

Figure 16:
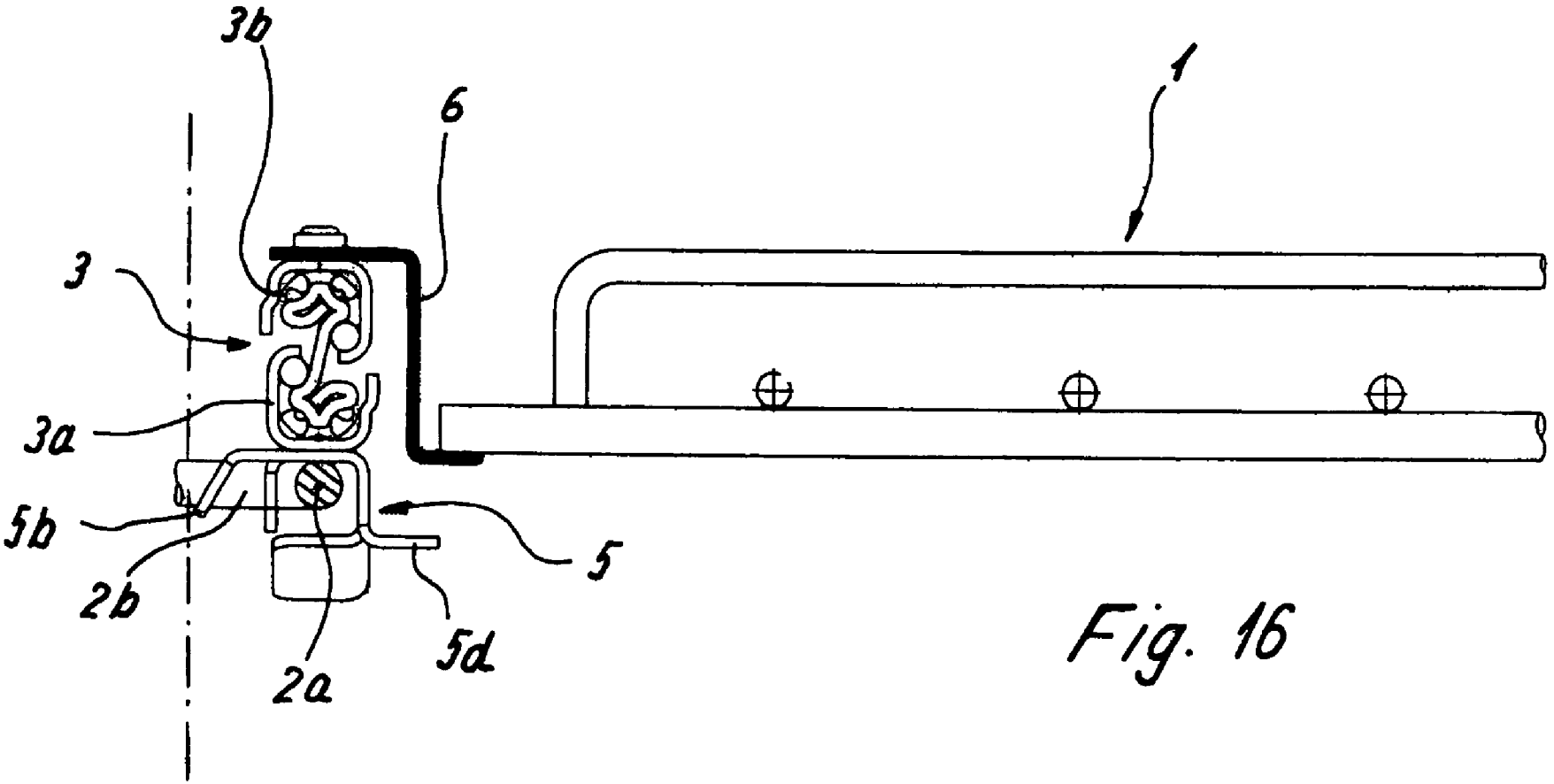

FIG. 16 is a sectional view of a support tray with forward holders according to FIGS. 13*a* to 13*d*, which essentially corresponds to FIG. 7.

DETAILED DESCRIPTION OF THE EMBODIMENTS

In the drawings, the reference number 1, in each case, indicates a support tray of a kitchen appliance as a whole which can be fixed to two mutually opposite supporting grids 2, but can also be removed again from these supporting grids 2 without any problem.

In the illustrated embodiment, the support tray 1 is constructed as a depositing grating and is used, for example, in a baking oven or a microwave oven or a refrigerator.

Deviating therefrom, such a support tray 1 can also have a closed tray surface.

The supporting grids 2 have a plurality of supporting rods 2*a* extending parallel to one another and are arranged in the side wall area of a baking oven or an other kitchen appliance which is not shown in detail. For further considerations, these supporting grids 2 may therefore be considered to be stationary within a kitchen appliance.

Figure 3:
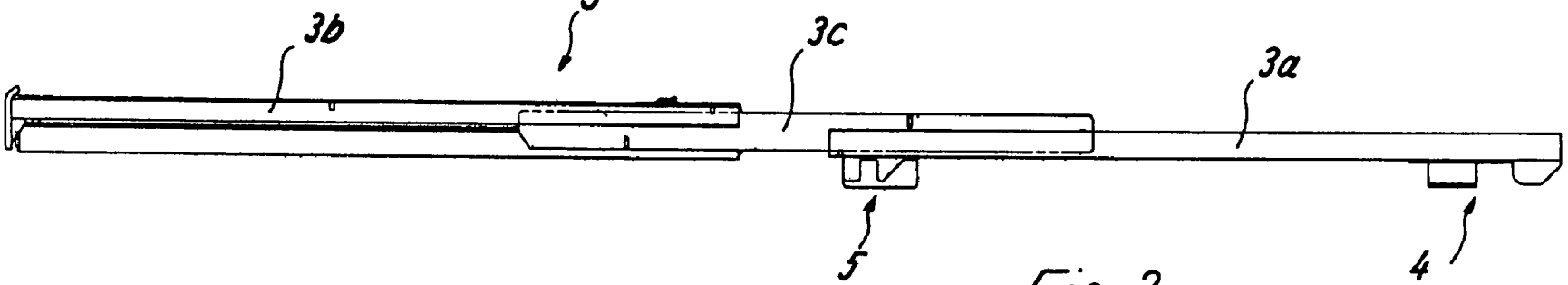
FIG. 3 is a view corresponding to FIG. 2 in the pulled out or extended condition of the guiding device.
Figure 4:
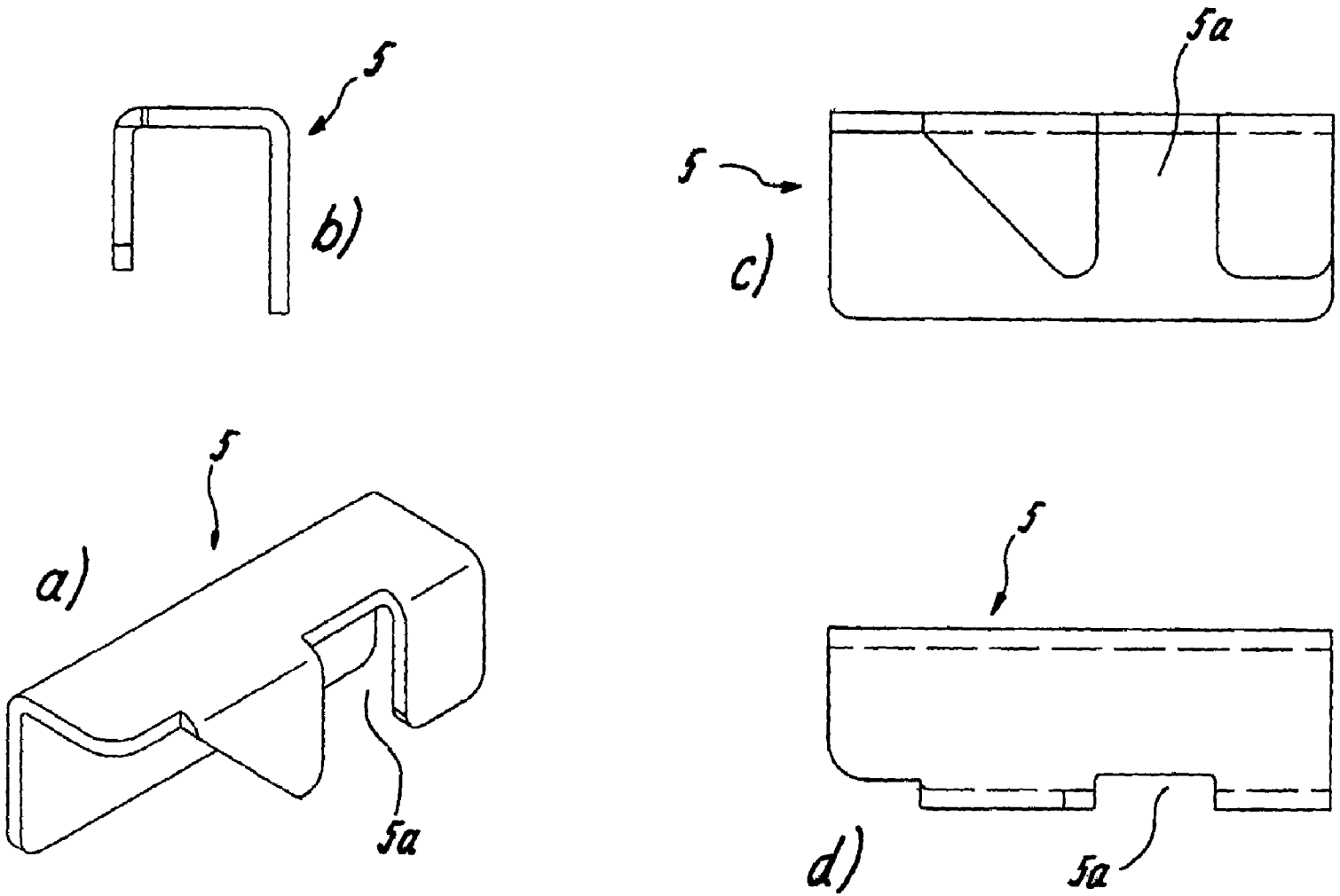

The support tray 1, which has a rectangular base area or tray 1*a* is equipped with guiding devices 3 at its two mutually opposite lateral edges. The guiding devices 3 are preferably constructed as telescopic guides, as illustrated in FIGS. 2 and 3. However, the guiding devices 3 at least have a guiding rail 3*a* and a running rail 3*b*. In order to implement a telescopic rail, a transition piece 3*c* is provided between the guiding rail 3*a* and the running rail 3*b*.

The support tray 1 is fixedly connected with the running rails 3*b* of the guiding devices 3. The connection may be a releasable connection or an unreleasable connection.

In their respective rearward end area, the guiding rails 3*a* of the guiding devices 3 are equipped with rearward holding devices 4, and in their respective forward area, are equipped with forward holders 5. The purpose is these couplers with 4 and 5 are to connect or couple these guiding rails 3*a* with the supporting rods 2*a* of the supporting grids 2 such that a lifting-off or tipping of the support tray 1 with respect to the supporting rods 2*a* in the rear area is prevented and, in the forward area, a protection against a displacement in the longitudinal direction of the supporting rods 2*a* is achieved.

This is ensured by the design of the rearward holding devices 4 and the forward holder 5 respectively, one embodiment which are illustrated in detail in FIGS. 5*a* to 5*d* and 4*a* to 4*d* respectively.

FIGS. 4*a* to 4*d* show that the forward holders have a U-shaped cross-section and are provided with a recess 5*a* in the area of one side leg. As illustrated in FIG. 8, an end piece 2*b* of the supporting rods, which is bent away transversely to the longitudinal direction of the supporting rods 2*a*, engages in this recess 5*a* so that a protection is obtained against the displacement of the guiding rail 3*a* in the longitudinal direction of the supporting rods 2*a*. This protection against a displacement can be removed by lifting the support tray 1 with the guiding devices 3 fastened thereto is lifted so far in its forward area that the end pieces 2*b* of the supporting rods 2*a* disengage from the recesses 5*a*.

The design of the rearward holding devices 4 illustrated in FIGS. 5*a* to 5*d* demonstrates that these rearward holding devices 4 are provided with two U-shaped sections 4*a* and 4*b* arranged offset with respect to one another in the longitudinal direction. The sections 4*a* and 4*b* are arranged offset with respect to one another by 90°. This results in the fact that a supporting rod 2*a* is completely enclosed by these rearward holding devices 4. A lifting of the guiding rail 3*a* off the used supporting rods 2*a* can therefore not take place.

Although, as a result of relatively generously dimensioned tolerances, a lifting of the support tray 1 and thus also of the guiding rail 3*a* in the forward area cannot take place until the forward holders 5 are released relative to the end pieces 2*b*. If, in contrast, for example, when the support tray 1 is pulled out, and is pressed downward, by a weight, the rearward end area of the guiding rails 3*a* cannot be lifted or tipped because of the enclosure of the supporting rods 2*a* by the rearward holding devices 4.

Nevertheless, by means of the described constructions, an unproblematic pushing of the guiding devices 3 onto the supporting rods 2*a* can take place just as well as an unproblematic removal of the guiding devices 3 from the supporting rods 2*a*. Thus, the handling in the practical every-day operation is considerably facilitated and simplified, with a maximum of safety during the use since the danger of an unintentional separation of the guiding devices 3 from the supporting rods 2*a*—as described above—is virtually prevented.

FIGS. 9 and 10 show that the forward holders 5 can also be constructed in the form of resilient clamps which, by means of a defined force, can be snapped upon the end pieces 2*b* or also separated again from the latter.

FIG. 7 shows that, for the connection between the running rail 3*b* of the guiding devices 3 and the tray 1*a*, an angle profile 6 can be used which can be welded to the tray 1*a* as well as to the running rails 3*b*. However, it is also conceivable to connect the angle profile 6 with the running rails 3*b* by a detachable connection, such as a screwed connection.

Figure 13:
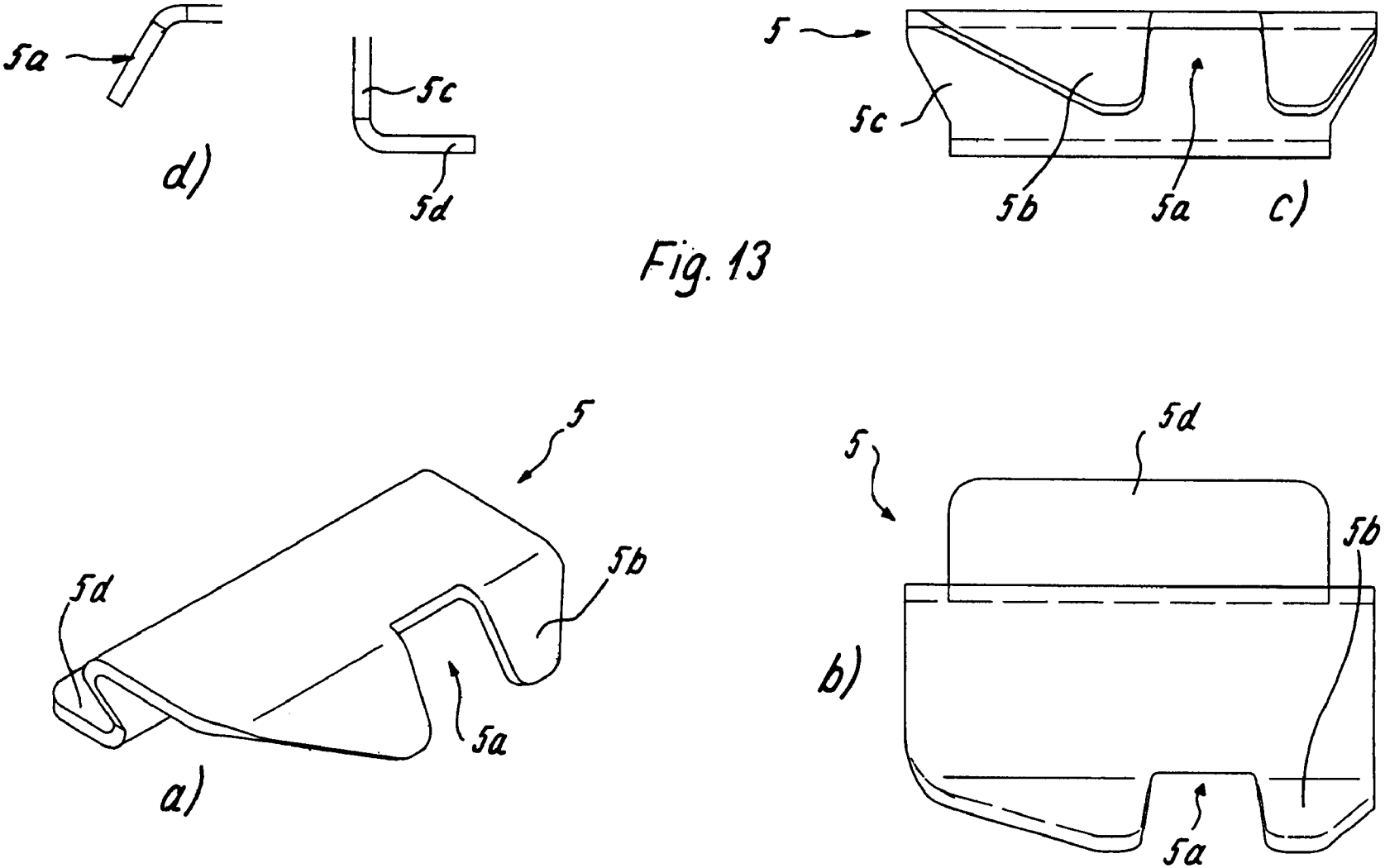
Figure 14:
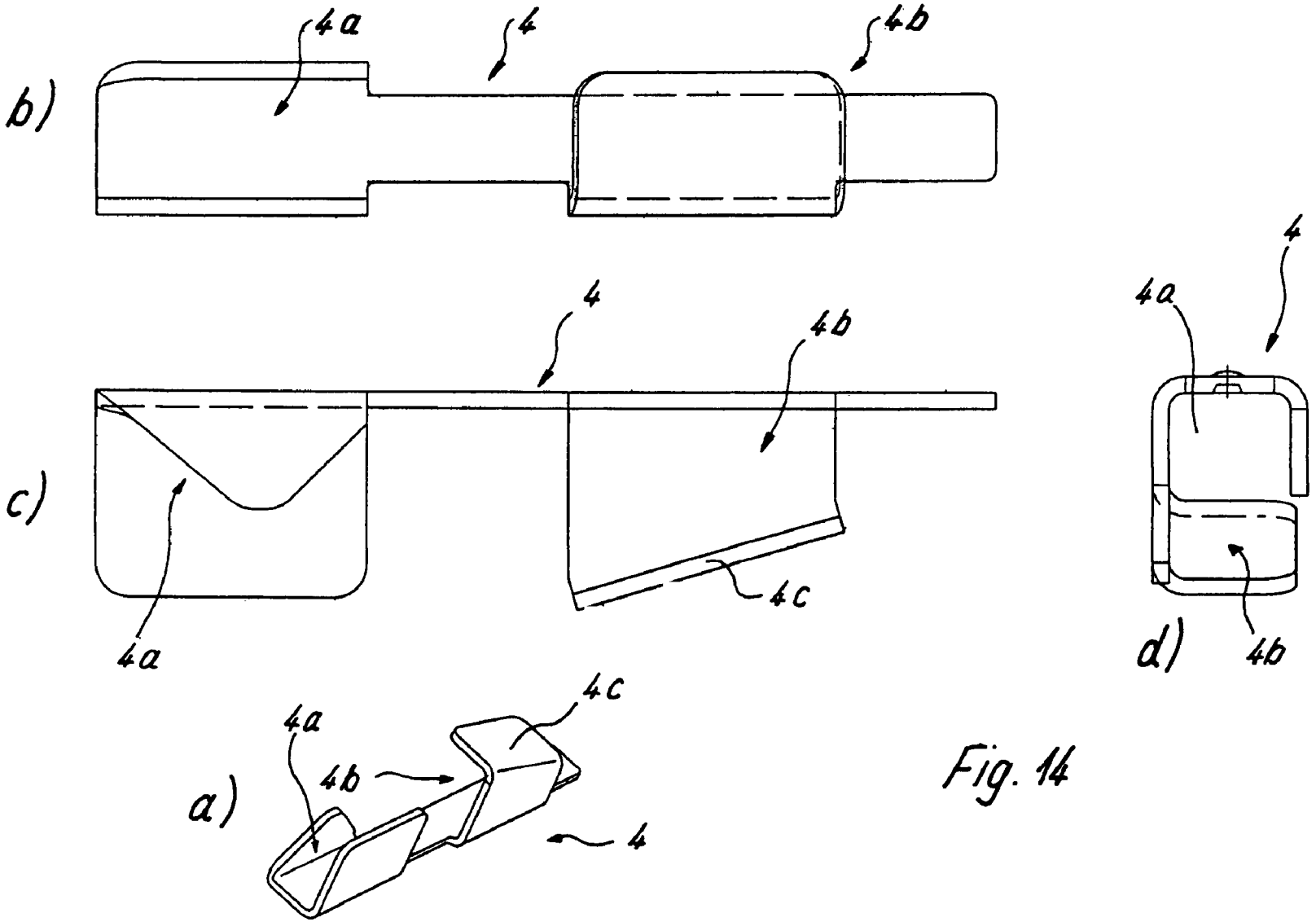

FIGS. 13*a* to 13*d* show another embodiment of the design of a forward holder 5. As in the case of the above-described embodiment, the holder 5, according to FIGS. 13*a* to 13*b*, is provided with a recess 5*a* to receive an end piece 2*b*, which is bent with respect to the longitudinal direction of the supporting rods 2*a*, in order to prevent a longitudinal displacement. Deviating from the described embodiments of FIG. 1, however, here the recess 5*a* is in a leg 5*b* which is bent away at a diagonal angle toward the outside. This leg 5*b* bent away to the outside at an angle reduces the lateral play to the interior wall of a kitchen appliance.

A gripping web 5*d* is molded to the inner leg 5*c* facing the tray 1*a*, which gripping web 5*d* facilitates the gripping of the forward holder 5 for the purpose of lifting the support tray 1.

Figure 5:
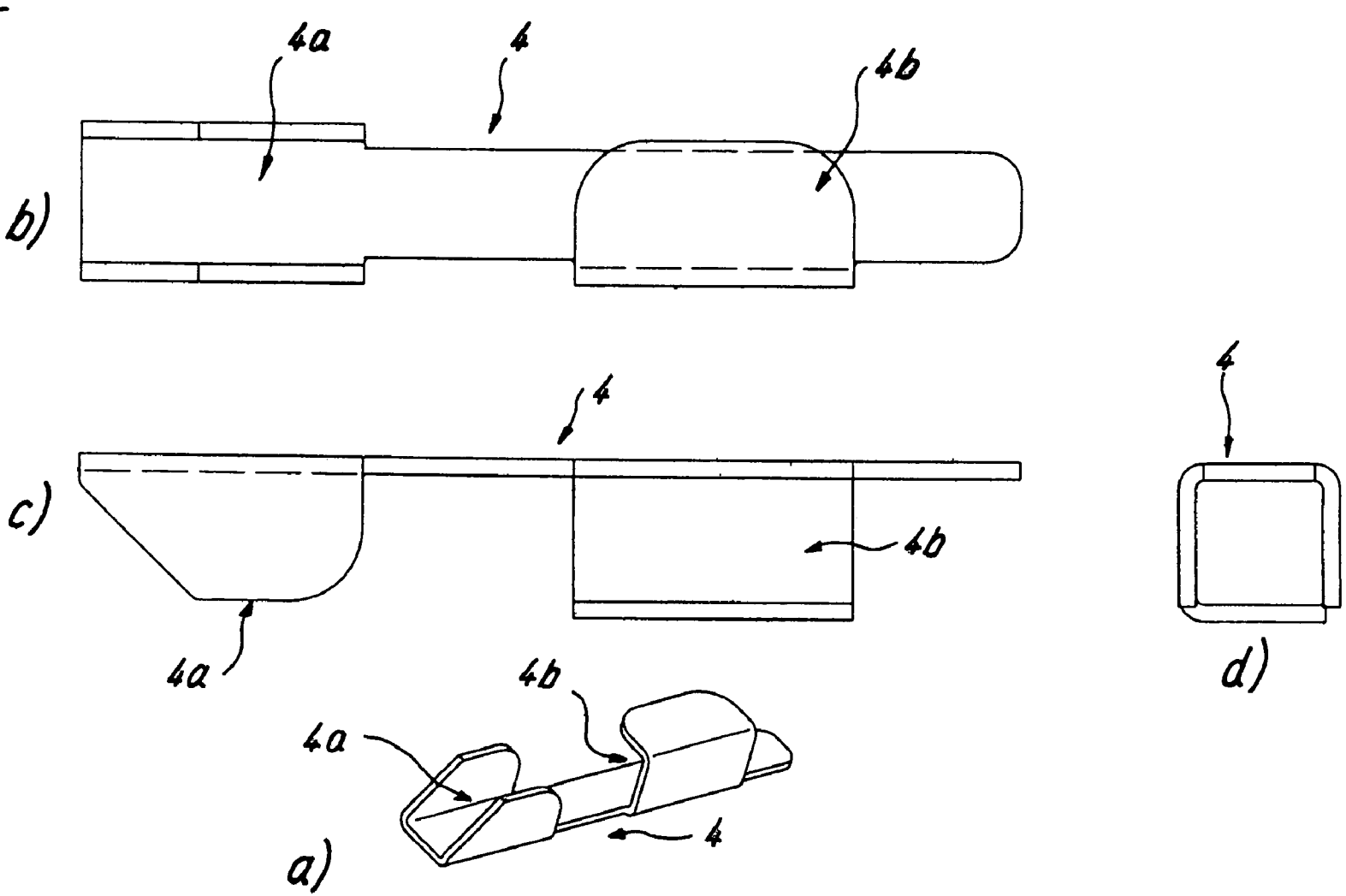

The rearward holding device 4 according to FIGS. 14*a* to 14*d* differs from the embodiments of FIG. 5 in that the gripping leg 4*c* of a U-shaped area 4*b* is designed diagonally sloping to the rear side, whereby the application of the rearward holding devices 4 to the supporting rods 2*a* and the insertion of the supporting rods 2*a* into these rearward holding devices 4 is facilitated.

If a use in a baking oven or the like is intended, the tray 1*a*, the guiding devices 3 and the holding devices 4 as well as the holders 5 are made of metal in order to ensure a sufficient heat resistance. However, if a support tray 1 is intended, for example, for a use in a refrigerator, all above-mentioned parts may be made of a plastic material.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A support tray for a kitchen appliance, such as a baking oven, a refrigerator, or a microwave oven, the support tray comprising:

a rectangular base area;

guiding devices coupled to the base area at each mutually opposite lateral edge of the support tray, the guiding device having a running rail connected to the support tray and a guiding rail to mount the support tray to supporting rods of supporting grids in side wall areas of the kitchen appliance;

the guiding rail is configured to be coupled and secured, in a rearward end area of the guiding rail, against a lifting-off from the supporting rods when coupled thereto and to be form-lockingly secured, in a forward end area of the guiding rail, against a displacement in a longitudinal direction of the supporting rods;

the guiding rail includes a first holding device in the rearward end area to secure the guiding rail against a lifting-off from the supporting rods; and the first holding device has two U-shaped areas which are arranged to be offset with respect to one another by 90 °, such that the U-shaped areas reach around the supporting rods on all sides.

2. The support tray according to claim 1, wherein a leg of one of the U-shaped areas reaches under a supporting rod and slopes in a direction of a rear side of the tray.

3. The support tray according to claim 1, wherein to secure the guiding rails against a displacement in the longitudinal direction of the supporting rods, the guiding rails include a second holding device in the forward end area of the guiding rails, and the second holding device includes a U-shaped cross-section which reaches over the supporting rods from above and includes a recess in an outer leg of the second holding device to receive an end area of the supporting rods which is bent away at an angle with respect to a longitudinal dimension of the supporting rods.

4. The support tray according to claim 3, wherein the outer leg including the recess is sloped pointing away from the support tray.

5. The support tray according to claim 3, wherein the second holding device includes an operating web bent away at an angle in the direction of the tray and extending from a side leg of the second holding device which faces the support tray.

6. The support tray according to claim 1, wherein to secure the guiding rails against a displacement in the longitudinal direction of the supporting rods, the guiding rails include a clamp-type holder which, in a spring-type manner, are snapped onto the forward end area bent-away at an angle with respect to the supporting rod.

7. The support tray according to claim 1, wherein the support tray is in the shape of a grid grating.

8. The support tray according to claim 1 , wherein the support tray is constructed as a component which is closed with respect to the surface.

9. The support tray according to claim 1, wherein the support tray and the guiding devices are made of metal.

10. The support tray according to claim 1 , wherein the support tray and the guiding devices are made of one of a plastic material and a combination of a plastic material and metal.

11. The support tray according to claim 1, wherein the support tray is connected by angle sections with the running rails of the guiding devices.

12. The support tray according to claim 11, wherein the support tray is fixedly connected with the running rails by the angle sections.

13. The support tray according to claim 11, wherein the support tray is detachably connected with the running rails by the angle sections and a screwed connection.

14. The support tray according to claim 1, wherein each guiding device includes at least one transition member telescopically connecting the guiding rail and the running rail.

* * * * *